US009683450B2

(12) United States Patent
Predmore et al.

(10) Patent No.: US 9,683,450 B2
(45) Date of Patent: Jun. 20, 2017

(54) TURBINE CASING INLET ASSEMBLY CONSTRUCTION

(71) Applicant: General Electric Company, Schenectady, NY (US)

(72) Inventors: Daniel Ross Predmore, Ballston Lake, NY (US); Richard Jon Chevrette, Troy, NY (US); Michael Christopher Jones, Niskayuna, NY (US); Erik Eduardo Lopez Partida, Clifton Park, NY (US); Sean Allen Smith, Guilderland, NY (US)

(73) Assignee: General Electric Company, Schenectady, NY (US)

( * ) Notice: Subject to any disclaimer, the term of this patent is extended or adjusted under 35 U.S.C. 154(b) by 1050 days.

(21) Appl. No.: 13/801,371

(22) Filed: Mar. 13, 2013

(65) Prior Publication Data

US 2014/0271139 A1 Sep. 18, 2014

(51) Int. Cl.

| | |
|---|---|
| ***F01D 17/16*** | (2006.01) |
| ***F01D 25/24*** | (2006.01) |
| ***F01D 11/18*** | (2006.01) |
| ***F04D 29/56*** | (2006.01) |
| ***F01D 9/02*** | (2006.01) |
| ***F01D 9/06*** | (2006.01) |

(52) U.S. Cl.

CPC ..... *F01D 9/06* (2013.01); *F01D 9/02* (2013.01); *F01D 11/18* (2013.01); *F01D 17/162* (2013.01); *F01D 25/24* (2013.01); *F01D 25/246* (2013.01); *F04D 29/563* (2013.01); *F05D 2240/12* (2013.01); *Y10T 29/49229* (2015.01)

(58) Field of Classification Search

CPC ..... F01D 17/162; F01D 25/246; F01D 25/24; F01D 11/18; F01D 9/02; F01D 9/06; F05D 2240/12; F04D 29/563; Y10T 29/49229

See application file for complete search history.

(56) References Cited

U.S. PATENT DOCUMENTS

| | | | | |
|---|---|---|---|---|
| 4,863,341 | A | 9/1989 | Groenendaal | |
| 6,629,819 | B1 | 10/2003 | Brown et al. | |
| 2002/0023575 | A1* | 2/2002 | Gatley, Jr. | F01D 25/24 110/182 |
| 2008/0213091 | A1 | 9/2008 | Lageder et al. | |
| 2012/0171010 | A1 | 7/2012 | Chevrette | |
| 2012/0195752 | A1* | 8/2012 | Lopez Partida | F01D 25/24 415/213.1 |

(Continued)

OTHER PUBLICATIONS

Office Action for U.S. Appl. No. 13/801,425, dated Mar. 9, 2016, 14 pages.

(Continued)

*Primary Examiner* — Mark Laurenzi
*Assistant Examiner* — Wesley Harris
(74) *Attorney, Agent, or Firm* — Ernest G. Cusick; Hoffman Warnick LLC

(57) ABSTRACT

A steam turbine inlet assembly and method of constructing the same are disclosed. In an embodiment, an annular ring is provided, along with a body affixed to a distal face of the annular ring and extending distally therefrom. The body portion has a curved entrance geometry at the proximal end adjacent the annular ring, and transitions to a substantially polygonal exit geometry at a distal end.

7 Claims, 11 Drawing Sheets

(56) References Cited

U.S. PATENT DOCUMENTS

2012/0282083 A1* 11/2012 Gonoor ..... F01D 25/24
415/182.1

OTHER PUBLICATIONS

Notice of Allowance for U.S. Appl. No. 13/801,425, dated Dec. 16, 2016, 11 pages.
Final Office Action for U.S. Appl. No. 13/801,425, dated Sep. 16, 2016, 7 pages.

* cited by examiner

TURBINE CASING INLET ASSEMBLY CONSTRUCTION

BACKGROUND OF THE INVENTION

The invention relates generally to turbomachinery, and more particularly, to inlet assembly construction for use in a low pressure section of a steam turbine.

A low pressure (LP) inlet in a steam turbine casing is designed to transfer working fluid, i.e. steam, from the power plant piping to an LP turbine section, where it causes the rotor to rotate. An inlet assembly can guide the flow to an inlet bowl, which can further redirect the flow, such as by turning it through an angle to be received by the rotor. Typically, the inlet bowl will be connected to the inlet assembly along an edge of the inlet bowl. The inlet assembly can shape and direct the flow from the circular cross section pipe to the polygonal or substantially polygonal exit geometry to minimize losses through the transition. Such losses may be caused by discontinuities and flow obstructions in the inlet passage surfaces.

Inlet assemblies have been manufactured using a cone as the base. Cone-based construction has several challenges. Cones may require significant handwork to transition from the circular geometry at the upstream end to the polygonal or substantially polygonal geometry of the downstream end. Cones are also particularly costly geometric shapes to fabricate, requiring rolling in two dimensions, and generating excess waste. Additionally, cone-based inlet assemblies may only achieve substantially polygonal exit geometry, having curved edges on two sides of the downstream end. This may add complexity to affixing the inlet assembly to the edge of the inlet bowl.

BRIEF DESCRIPTION OF THE INVENTION

A first aspect of the disclosure provides a steam turbine inlet assembly comprising: an annular ring; and a body affixed to a distal face of the annular ring, extending distally therefrom. The body has a curved entrance geometry adjacent the annular ring, and transitions to a substantially polygonal exit geometry at a distal end.

A second aspect of the disclosure provides a method of forming a turbine casing inlet assembly, the method comprising: forming a transition portion having a curved entrance geometry, and forming a main body portion disposed distally of the transition portion, the main body portion having a substantially polygonal exit geometry. The transition portion forming includes using a first hollow semi-cylinder and a second hollow semi-cylinder to form the transition portion, and truncating each of the first and the second hollow semi-cylinders at a distal end and a proximal end thereof.

These and other aspects, advantages and salient features of the invention will become apparent from the following detailed description, which, when taken in conjunction with the annexed drawings, where like parts are designated by like reference characters throughout the drawings, disclose embodiments of the invention.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

Figure 1:
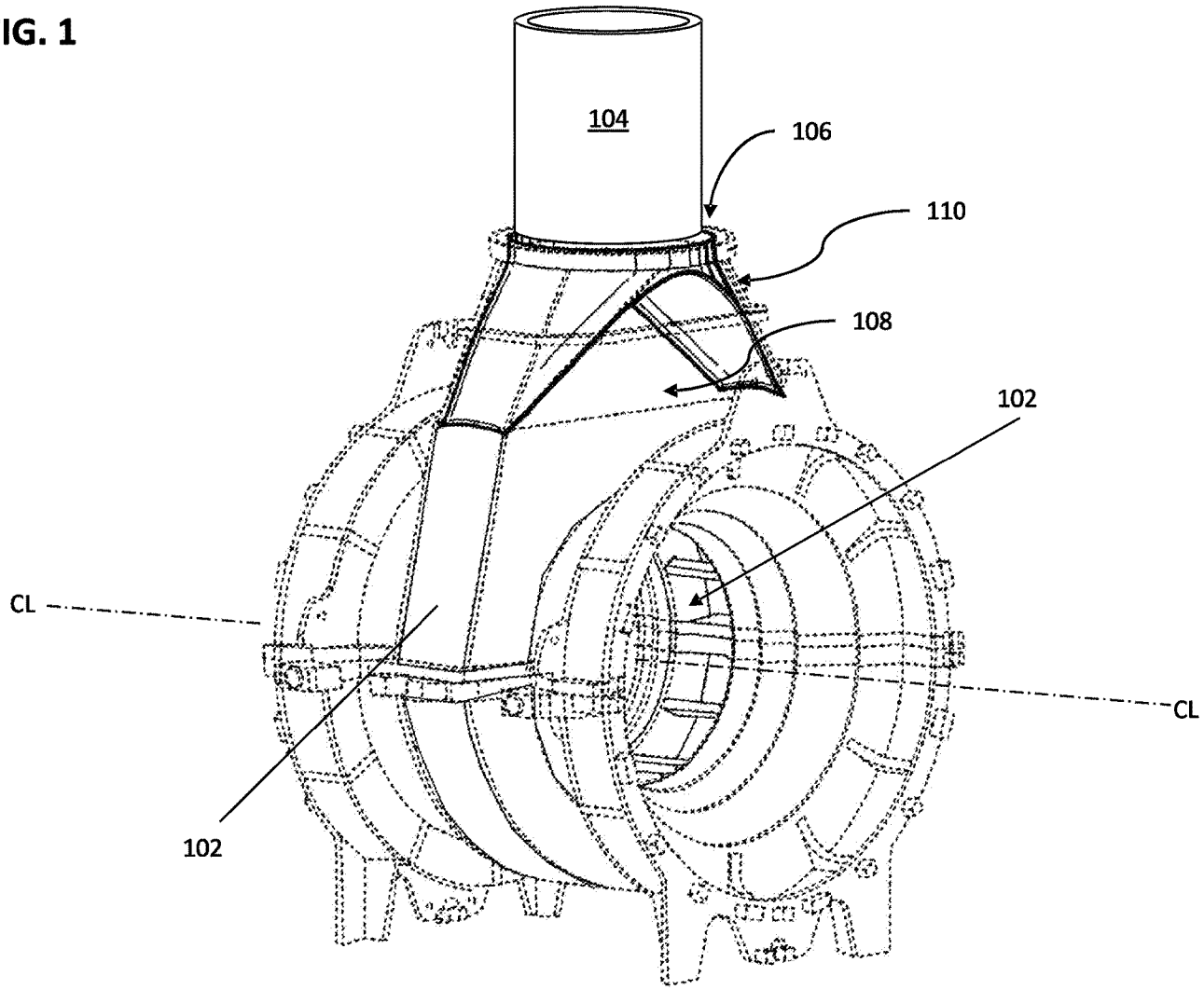
FIG. 1 shows a perspective view of a turbine casing including a supply conduit feeding into a turbine casing inlet assembly.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

At least one embodiment of the present invention is described below in reference to its application in connection with an inlet assembly in a casing for a low pressure (LP) section of a steam turbine. Although embodiments of the invention are illustrated relative to a steam turbine LP section inlet assembly, it is understood that the teachings are equally applicable to inlet assemblies which transition from a curved geometry at an upstream end to a polygonal geometry at a downstream or exit end. Such a curved geometry may be, e.g., circular or substantially circular, elliptical, or having a racetrack shape. It should be apparent to those skilled in the art that the present invention is likewise applicable to any suitable inlet assembly. Further, it should be apparent to those skilled in the art that the present invention is likewise applicable to various scales and dimensions.

As indicated above, aspects of the invention provide an inlet assembly structure and method of constructing the same.

With reference to FIG. 1, a turbine casing can include one or more inlets 102 with which an inlet assembly 110 may be used. Inlet assembly 110 can take fluid from a supply conduit 104, reshape and/or accelerate the flow, and redirect the flow into one or more turbine casing inlets 102. Inlet assembly 110 can include an entry 106 configured to be connected to supply conduit 104 and at least one exit 108 configured to transfer fluid to a respective turbine casing inlet 102. Flow can be redirected, for example, along a centerline CL of turbine casing inlet 102 in some embodiments.

Methods of forming inlet assembly 110 according to embodiments of the invention are described below with reference to FIGS. 2-18.

With reference to FIGS. 2-14, a transition portion 36, which may have a curved entrance geometry 52 (see, e.g., FIGS. 7-8) is formed using first hollow semi-cylinder 12 and second hollow semi-cylinder 14.

Figure 2:
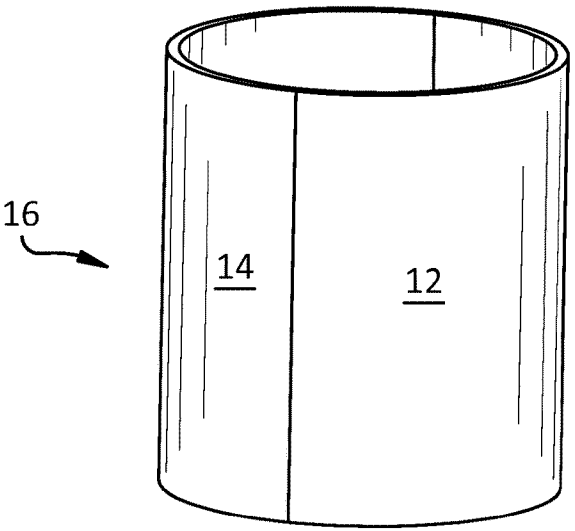
FIGS. 2-6 show perspective views of steps in a method of forming a turbine casing inlet assembly according to embodiments of the invention.

As shown in FIG. 2, first hollow semi-cylinder 12 and second hollow semi-cylinder 14 may be formed by providing a hollow cylinder 16 made of rolled steel, and longitudinally bisecting hollow cylinder 16. However, first and second hollow semi-cylinders 12, 14 need not be halves of the same hollow cylinder 16. Hollow cylinder 16 may be a right circular cylinder as shown in FIG. 2, or may in other embodiments be, for example, an elliptic cylinder.

Figure 3:
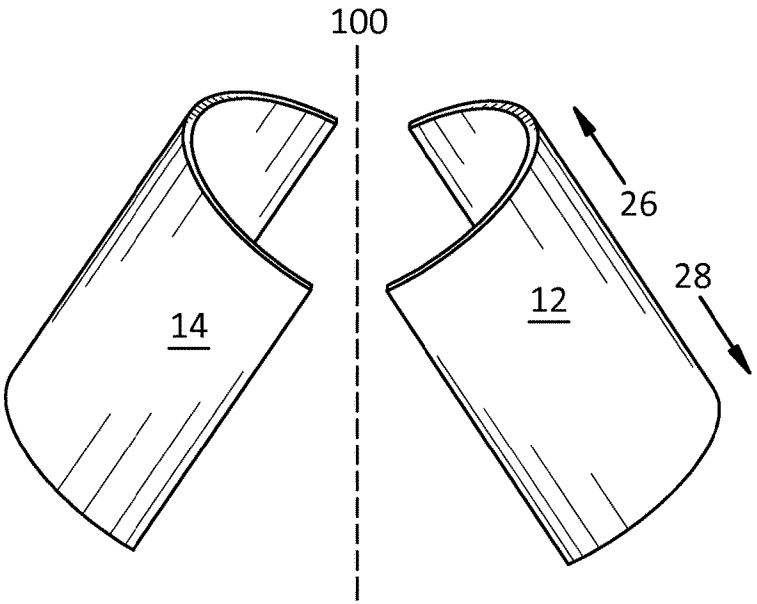

As shown in FIG. 3, first hollow semi-cylinder 12 and second hollow cylinder 14 may be angled with respect to one another. Relative to the position of FIG. 2 in which each of first and second hollow semi-cylinders 12, 14 are mated to one another to form a complete hollow cylinder 16 and are substantially parallel to one another, in FIG. 3, a proximal end 26 of each of first and second hollow semi-cylinders 12, 14 is rotated radially inward, toward one another and toward a center line 100. At the same time, distal end 28 of each of first and second hollow semi-cylinders 12, 14 rotates radially outward.

Figure 4:
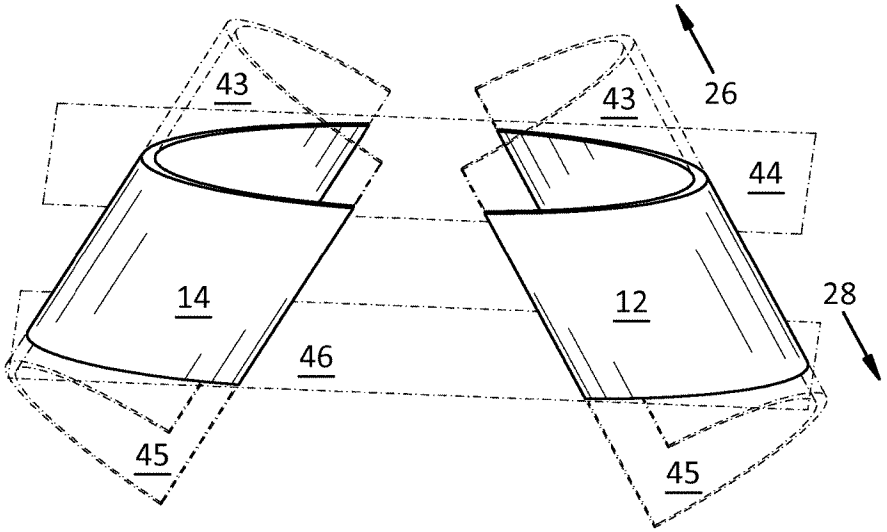
Figure 5:
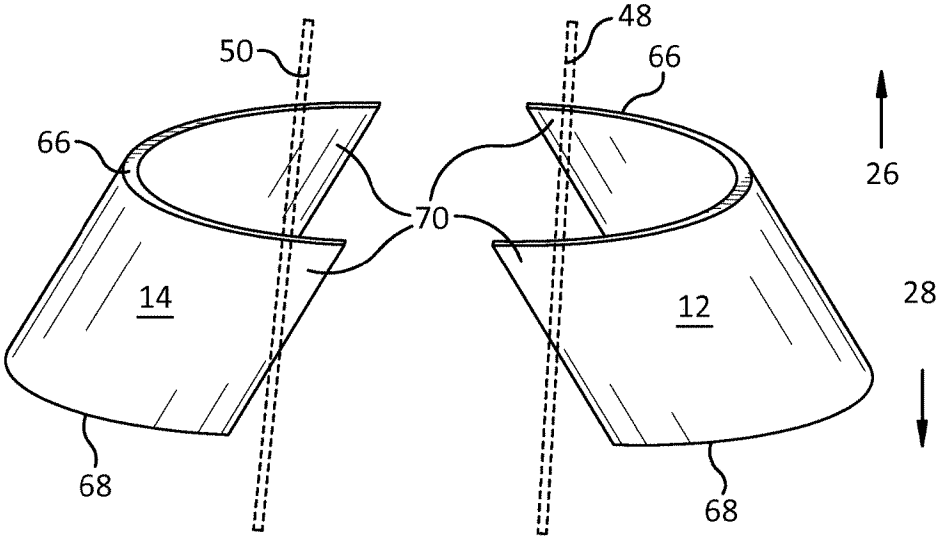

As shown in FIGS. 4-5, each of the angled first and the second hollow semi-cylinders 12, 14 may be truncated at both the proximal 26 and distal 28 ends thereof As shown in FIG. 4, truncating the proximal end 26 of first and second hollow semi-cylinders 12, 14 may include removing a proximal portion 43 from each of the angled first and second hollow semi-cylinders 12, 14. Proximal portion 43 may be defined by the intersection of a first horizontal plane 44 with the angled first and second hollow semi-cylinders 12, 14. This truncation may result in a proximal edge 66 of each of the first and second hollow semi-cylinders 12, 14 that has a semi-ovoid shape, as shown in FIG. 5.

Referring back to FIG. 4, truncating the distal end 28 of first and second hollow semi-cylinders 12, 14 may be done in a similar manner, by removing distal portion 45 from each of the angled first and second hollow semi-cylinders 12, 14. Distal portion 45 may be defined by the intersection of a second horizontal plane 46 with the angled first and second hollow semi-cylinders 12, 14. This truncation may result in a distal edge 68 of each of the first and second hollow semi-cylinders 12, 14 that has a semi-ovoid shape, as shown in FIG. 5.

Figure 7:
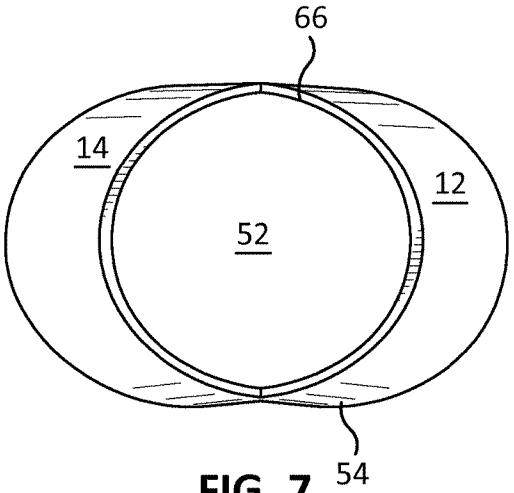
FIG. 7 shows a top view of a step in a method of forming a turbine casing inlet assembly according to an embodiment of the invention.
Figure 6:
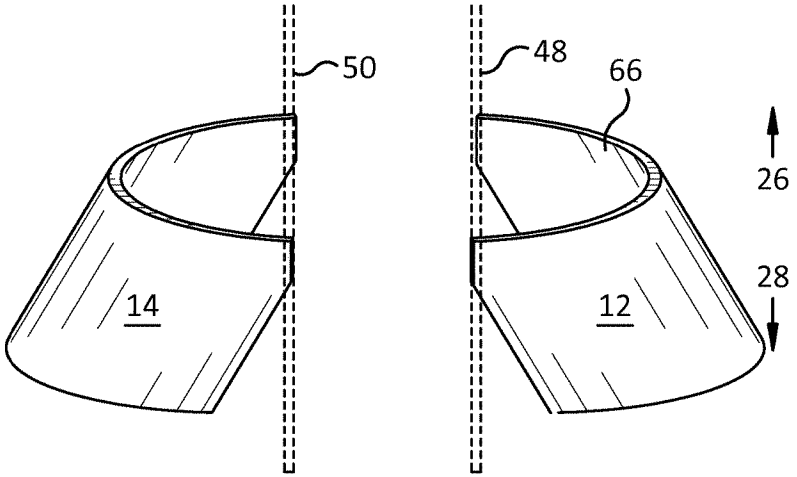
Figure 8:
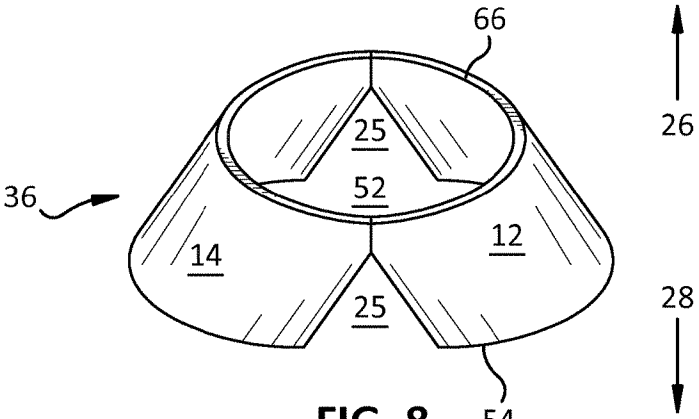
FIGS. 8-12 show perspective views of steps in a method of forming a turbine casing inlet assembly according to embodiments of the invention.

Referring to FIGS. 5-6, proximal end 26 of each of first and second hollow semi-cylinders 12, 14 may further be truncated by removing a proximal portion 70 (FIG. 5) of each of the angled first and second hollow semi-cylinders 12, 14 defined by the intersection of first and second substantially vertical planes 48, 50 with each of the angled first and second hollow semi-cylinders 12, 14 respectively (FIGS. 5-6). After removal of proximal portion 70 (FIGS. 6-8), proximal edge 66 may be substantially semi-circular rather than substantially ovoid (FIG. 5). After proximal portion 70 is removed (FIG. 6), the angled and truncated first and second hollow semi-cylinders 12, 14 may be placed adjacent one another as shown in FIGS. 7-8, such that the portions of first and second hollow semi-cylinders 12, 14 where proximal portions 70 have been removed are disposed adjacent one another. The proximal ends 26 of the first and second hollow semi-cylinders 12, 14 form curved entrance geometry 52 of transition portion 36, and distal ends 28 have a substantially ovoid footprint 54, although the substantially ovoid footprint 54 is not continuous, due to the approximately triangular spaces 25 between first and second hollow semi-cylinders 12, 14 (FIGS. 7-8).

Figure 9:
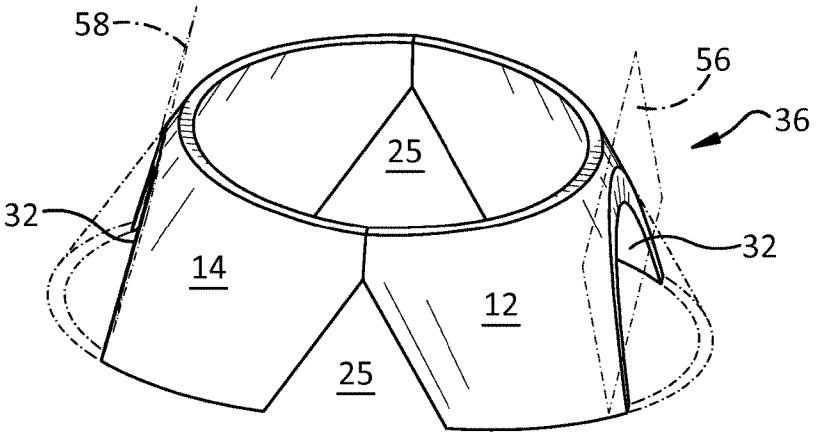
Figure 10:
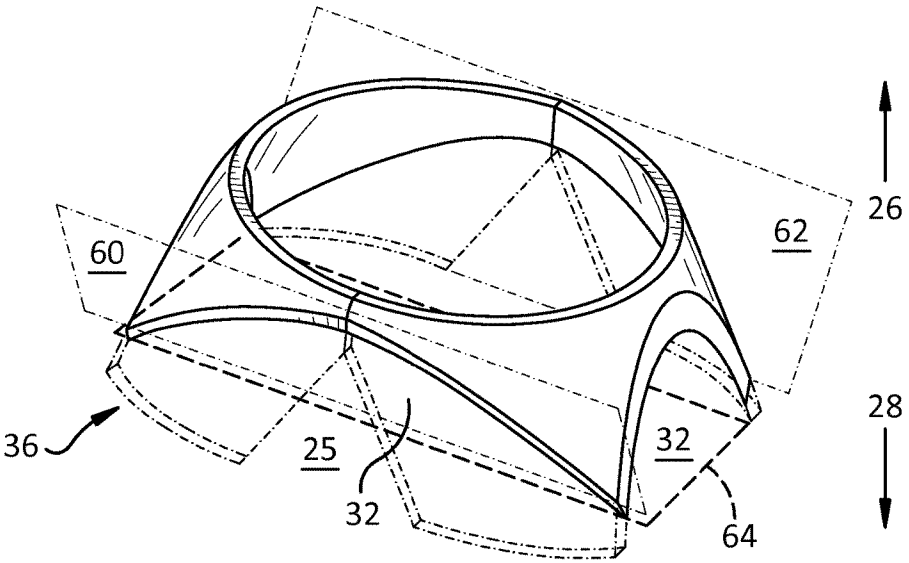
Figure 11:
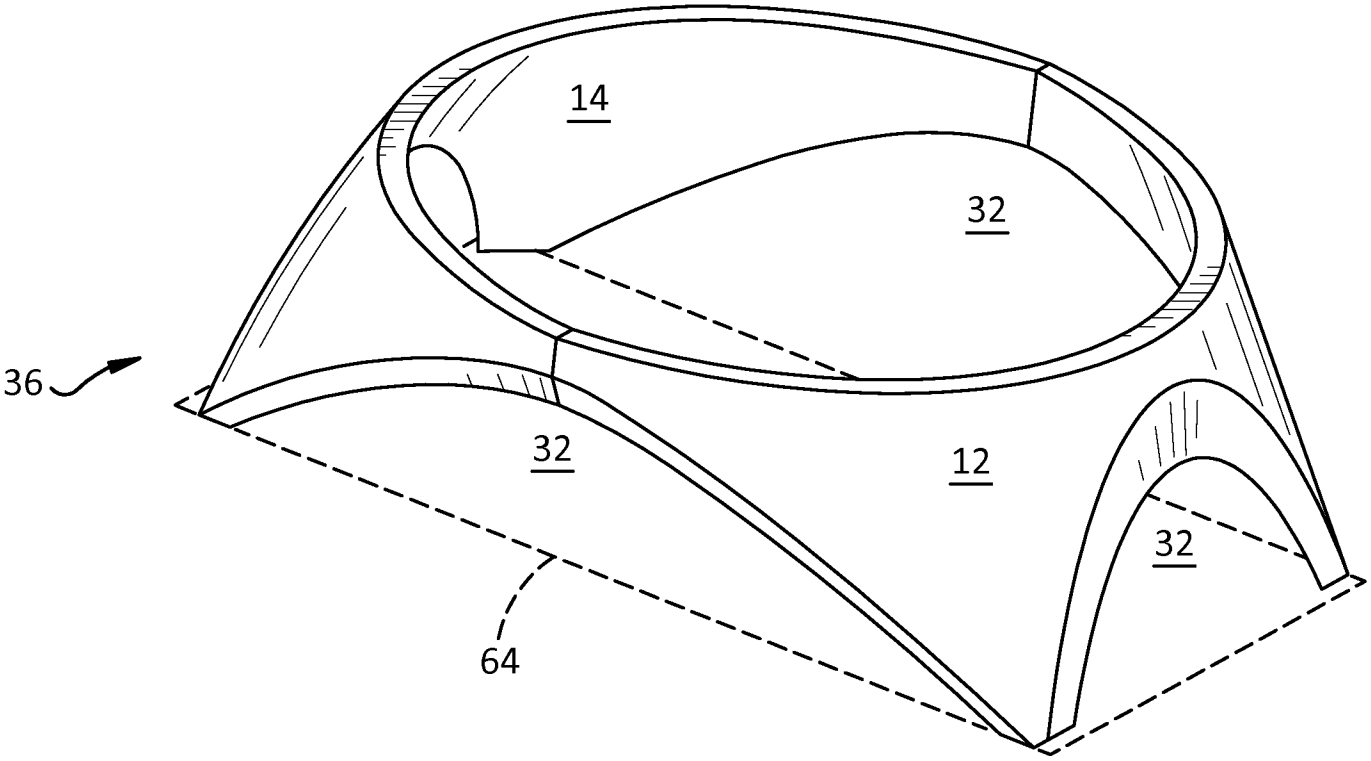

Referring to FIGS. 9-11, distal ends 28 of first and second hollow semi-cylinders 12, 14 may also be further truncated to shape transition portion 36. As shown in FIGS. 9 and 10, portions of distal ends 28 of each of the first and second hollow semi-cylinders 12, 14 may be removed such that a substantially arch-shaped opening 32 is formed in each of four sides of transition portion 36, and pointed rather than curved ends are formed. This may be accomplished by removing a distal portion of the first hollow semi-cylinder 12 defined by the intersection of a third plane 56 with the first hollow semi-cylinder 12, and a distal portion of the second hollow semi-cylinder 14 defined by the intersection of a fourth plane 58 with the second hollow semi-cylinder 14 as shown in FIG. 9. Third and fourth planes 56, 58 may be angled such that the base at distal end 28 defined by the planes 56, 58 is wider than at proximal end 26. Further, as shown in FIG. 10, a distal portion of each of the first and second hollow semi-cylinders 12, 14 defined by the intersection of a fifth plane 60 with the first and second hollow semi-cylinders 12, 14; a distal portion of each of the first and second hollow semi-cylinders 12, 14 defined by the intersection of a sixth plane 62 with the first and the second hollow semi-cylinders 12, 14 may also be removed. Fifth and sixth planes 60, 62 may be angled such that the base at distal end 28 defined by the planes 60, 62 is narrower than at proximal end 26. As shown in FIGS. 10-11, the intersections of each of the third 56, fourth 58, fifth 60, and sixth 62 planes with the distal end 28 of each of the first and second hollow semi-cylinders 12, 14 may form a substantially rectangular footprint 64. Thus truncated as shown in FIG. 11, first and second hollow semi-cylinders 12, 14 form transition portion 36 which transitions from the curved entrance geometry 52 to the substantially polygonal exit geometry 40 of the completed inlet assembly 110 (FIG. 15).

Figure 12:
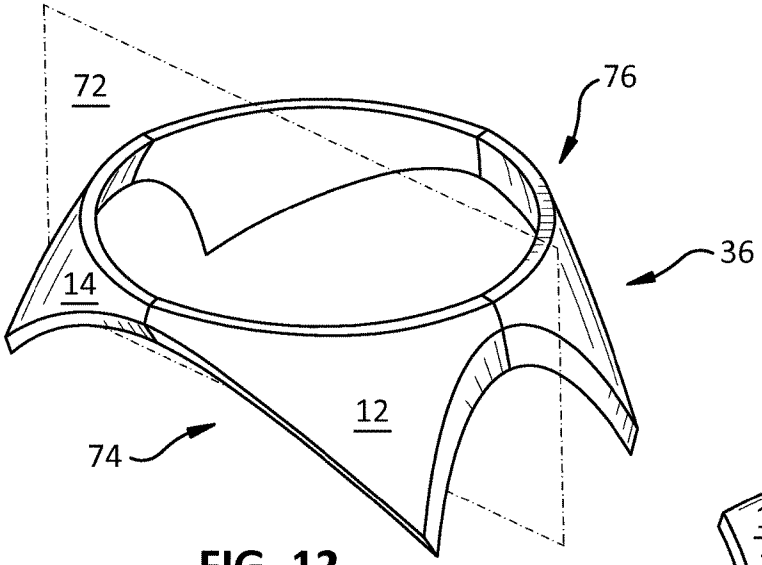
Figure 13:
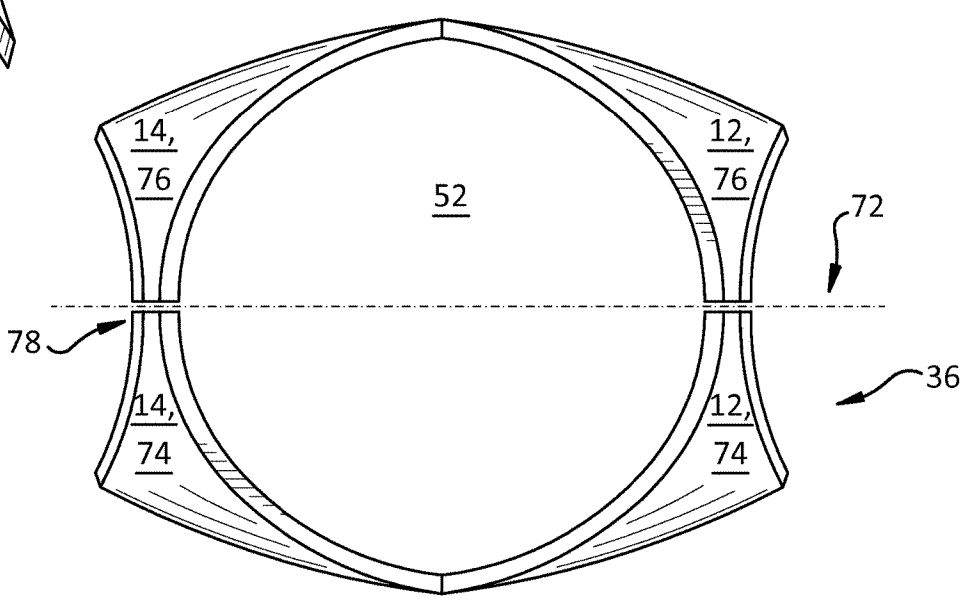
FIG. 13 shows a top view of a portion of a turbine casing inlet assembly as shown in FIG. 12, according to an embodiment of the invention.

In some embodiments, as shown in FIGS. 12-13, each of the first and second hollow semi-cylinders 12, 14 may be substantially bisected, e.g., by substantially vertical plane 72 to define an anterior 74 and a posterior 76 half of transition portion 36. Anterior 74 and posterior 76 halves may then be separated from one another, leaving space 78 between the halves of each of first and second hollow semi-cylinders 12, 14. The relative positions of anterior 74 and posterior 76 halves and the resultant size of space 78 can be adjusted according to requirements discussed further below.

Figure 14:
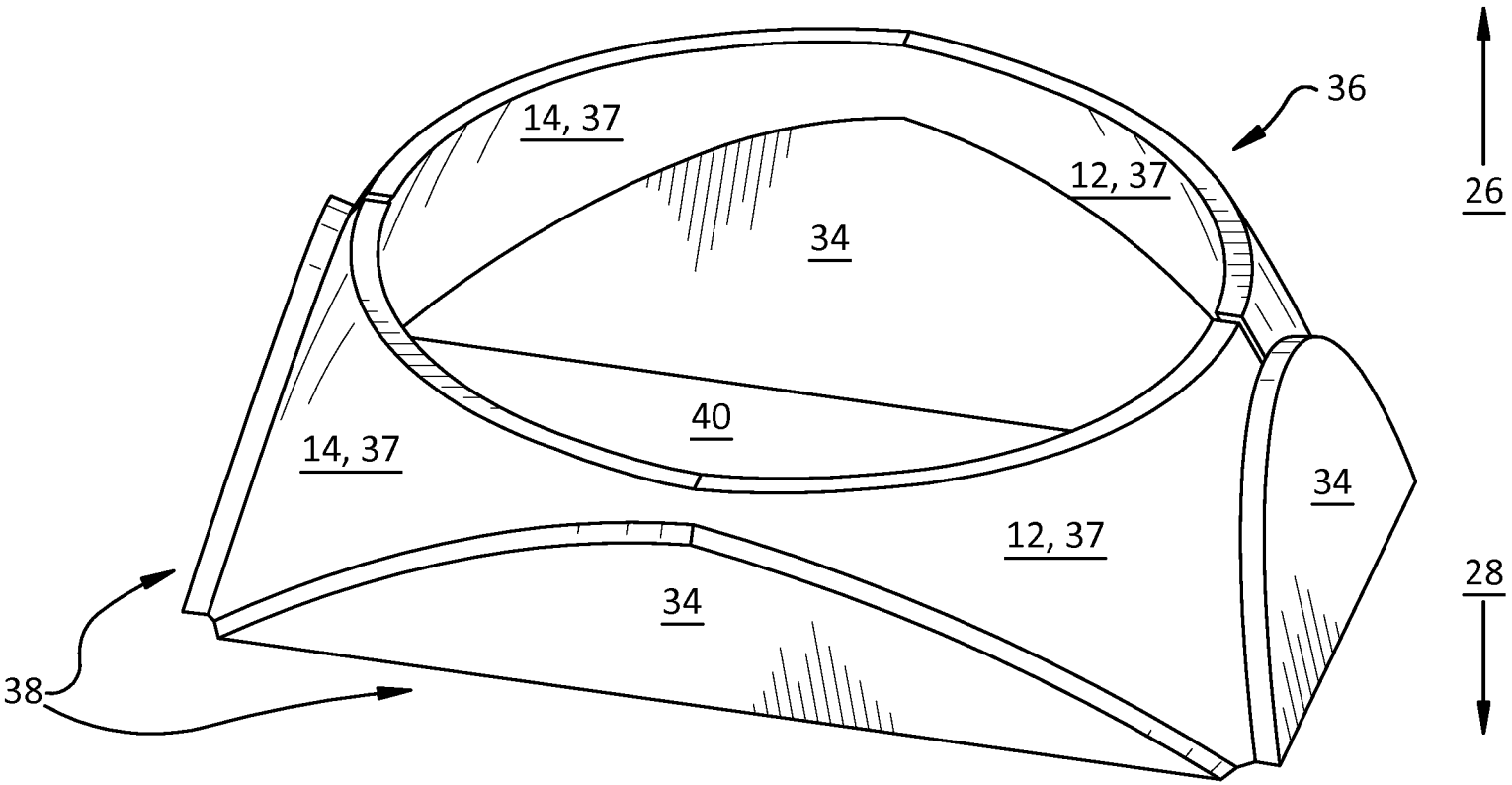
FIGS. 14-15 show perspective views of steps in a method of forming a turbine casing inlet assembly according to embodiments of the invention.

As shown in FIG. 14, main body portion 38 may be formed at distal end 28 of transition portion 36. Main body portion 38 may be formed by matingly engaging a plate 34 with each of the substantially arch-shaped openings 32. At distal end 28, the flat distal edges of plates 34 form the substantially polygonal exit geometry 40 of the main body portion 38. In some embodiments, the substantially polygonal exit geometry 40 of the main body portion 38 may be a parallelogram, and in particular, may be rectangular. Substantially polygonal exit geometry 40 allows for coupling to, e.g., an inlet bowl. The joints between each of plates 34 and each of the respective substantially arch-shaped openings 32 may be welded to affix plates 34 in position. Additionally, anterior 74 and posterior 76 halves of transition portion 36 may be welded in position with respect to one another, and any gaps such as spaces 78 may be welded closed.

Figure 15:
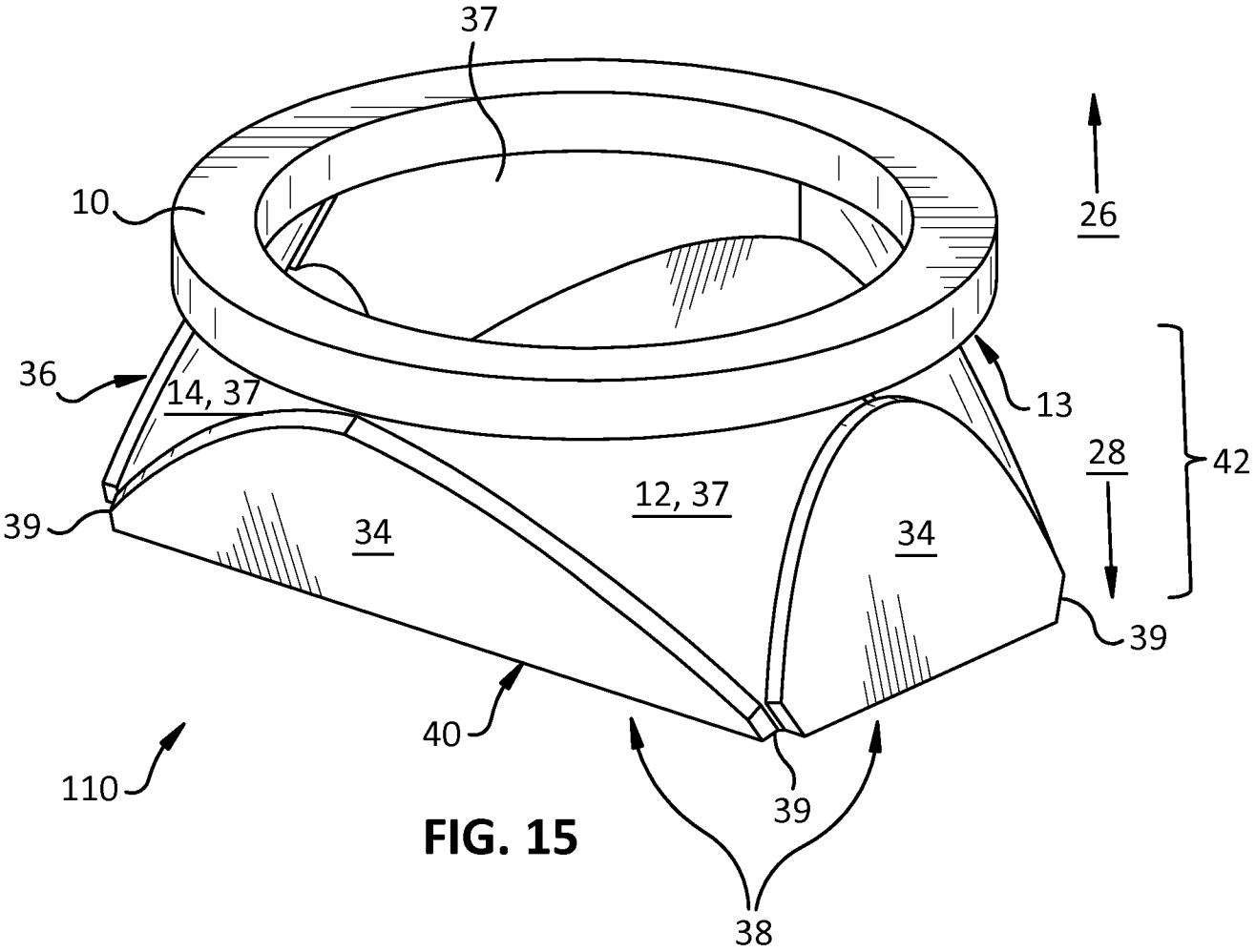

As shown in FIG. 15, annular ring 10 may be affixed to the curved entrance geometry 52 at the proximal end 26 of transition portion 36. Annular ring 10 allows for coupling to supply conduit 104 (FIG. 1). An outer diameter of annular ring 10 may be disposed radially outward of the outer surfaces of each of first and second hollow semi-cylinders 12, 14, as the thickness of annular ring 10 may be greater than the thickness of first and second hollow semi-cylinders 12, 14 to accommodate bolts for affixing annular ring 10 to supply conduit 104 (FIG. 1).

As discussed above, the positioning of anterior half 74 and posterior half 76 of transition portion 36 (FIGS. 12-13) may be adjusted. This may be done prior to affixing annular ring 10 to transition portion 36, such that an inner diameter of the curved entrance geometry 52 of transition portion 36 substantially aligns with an inner diameter of the annular ring 10. If the inner diameter of annular ring 10 is slightly larger than the inner diameter of curved entrance geometry 52, anterior half 74 and posterior half 76 may be moved further apart, enlarging space 78 (FIG. 13), effectively enlarging the inner diameter of curved entrance geometry 52.

Figure 17:
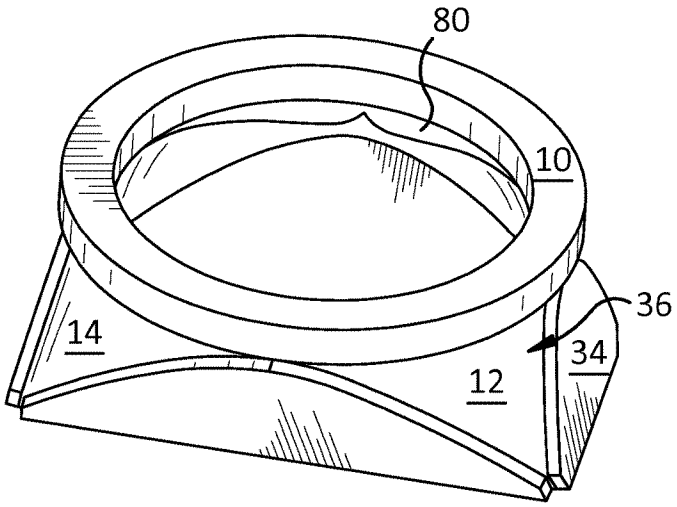
FIGS. 17 and 18 show a perspective view and a top view respectively of a step in a method of forming a turbine casing inlet assembly according to an embodiment of the invention.
Figure 18:
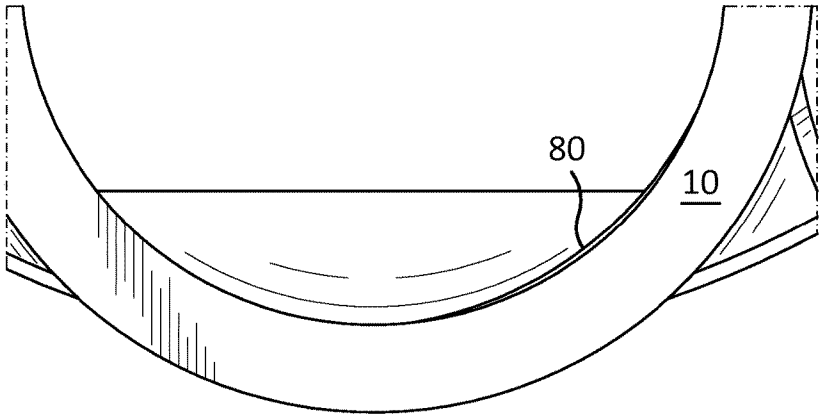

As shown in FIGS. 17-18, the method may further include a step of machining or trimming the joint between annular ring 10 and each of first and second hollow semi-cylinders 12, 14 to smooth an interior surface of inlet assembly 110. This may be done to smooth any protuberances 80 which might otherwise obstruct or unintentionally redirect flow of steam through the inlet. Such protuberances 80 may occur if, e.g., curved entrance geometry 52 of transition portion 36 is slightly ovoid rather than perfectly round.

As discussed above, in another aspect of the disclosure, a steam turbine inlet assembly 110 is provided, providing a transition from the upstream circular cross section geometry of, e.g., a supply conduit, to a polygonal exit geometry for coupling to, e.g., an inlet bowl.

As shown in FIG. 15, inlet assembly 110 may include an annular ring 10, and a body 42 affixed to a distal face 13 of the annular ring 10 and extending distally therefrom. Body 42 has a curved entrance geometry 52 adjacent to annular ring 10, and transitions in cross sectional shape to a substantially polygonal exit geometry 40 at a distal end 28.

Body 42 may include a transition portion 36, which includes the curved entrance geometry 52. In some embodiments, an inner diameter of annular ring 10 is substantially the same as an inner diameter of curved entrance geometry 52 of the transition portion 36. In further embodiments, an inner diameter of annular ring 10 and an inner diameter of curved entrance geometry 52 of transition portion 36 are substantially aligned with one another, minimizing any discontinuities in the fluid flow path through inlet assembly 110.

Transition portion 36 may be made up of four approximately triangular convexly curved facets 37 arranged about the annular ring 10, such that each of the approximately triangular curved facets 37 includes a vertex 39 disposed approximately at a corner of the substantially polygonal exit geometry 40. Transition portion 36 may further have a convexly curved outer surface, such that each approximately triangular curved facet 37 has a convex curvature to its outer surface.

Figure 16:
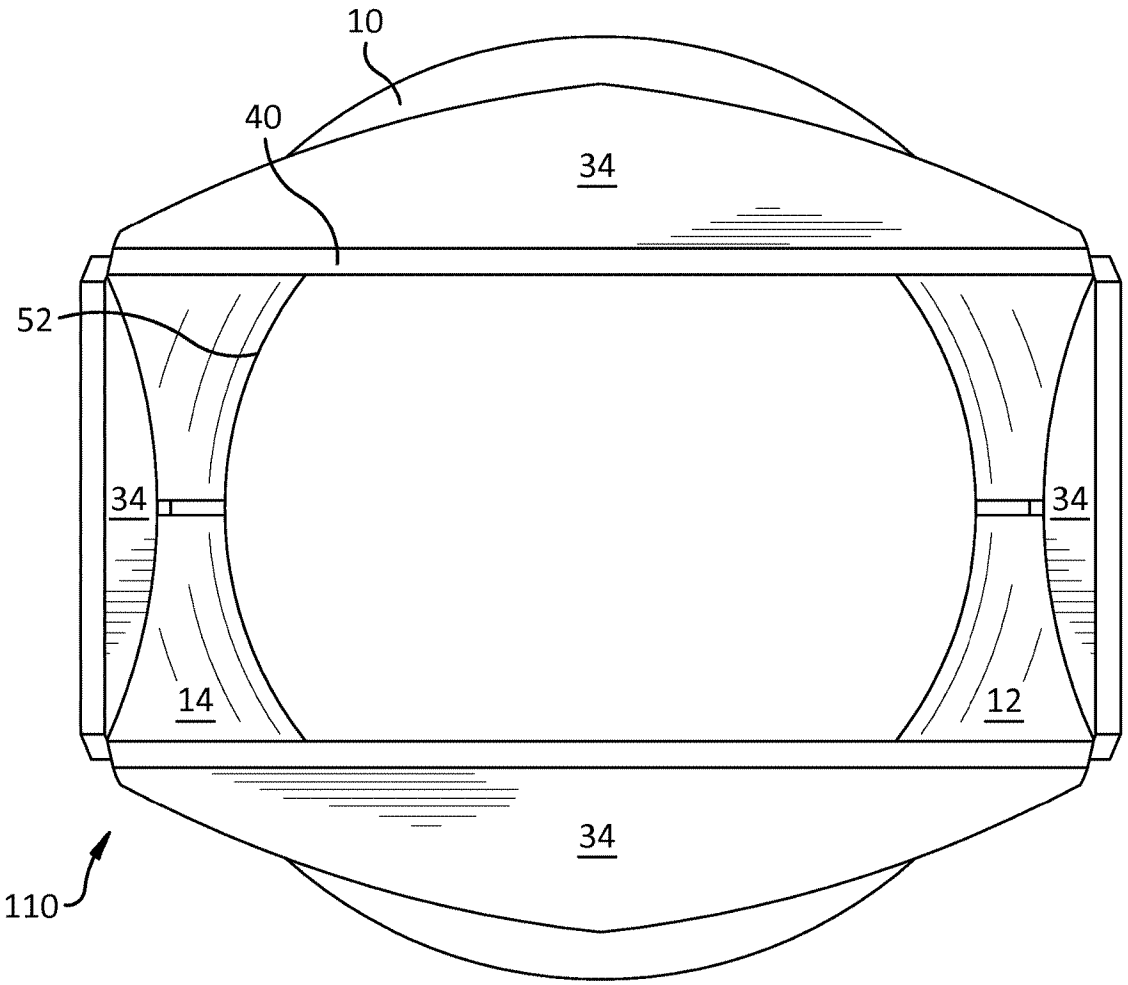
FIG. 16 shows a bottom view of a portion of a turbine casing inlet assembly as shown in FIG. 15, according to an embodiment of the invention.

Body 42 may further include a main body portion 38 having a substantially polygonal exit geometry 40. The substantially polygonal exit geometry 40 may in some embodiments be a parallelogram, and may further be rectangular. Main body portion 38 may include four plates 34, each of the plates 34 being disposed and matingly engaged between two approximately triangular curved facets 37. It is noted that approximately triangular curved facets 37 are not strictly triangular, but only approximately so; some of the sides may be rounded as opposed to straight, and/or some of the angles may be curves. The four plates 34 form the sides of the substantially polygonal exit geometry 40 (FIGS. 15-16).

Transition portion 36, including approximately triangular curved facets 37, may be welded to main body portion 38, including plates 34. Body 42, made up of transition portion 36 and main body 38, may be made of rolled steel in some embodiments.

As used herein, the terms "first," "second," and the like, do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 mm, or, more specifically, about 5 mm to about 20 mm," is inclusive of the endpoints and all intermediate values of the ranges of "about 5 mm to about 25 mm," etc.).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A steam turbine inlet assembly comprising:

an annular ring; and a body affixed to a distal face of the annular ring, extending distally therefrom, wherein the body includes:

a transition portion having a curved entrance geometry adjacent the annular ring, a convexly curved outer surface, and four convexly curved facets arranged about the annular ring, a main body portion having polygonal exit geometry at a distal end, and four plates, each of the plates being disposed and matingly engaged between two of the four curved facets, wherein one of the four plates is disposed between each adjacent facet, and wherein each of the curved facets includes a vertex disposed approximately at a corner of the polygonal exit geometry.

2. The steam turbine inlet assembly of claim 1, wherein each of the four plates are flat plates.

3. The steam turbine inlet assembly of claim 1, wherein an inner diameter of the annular ring is the same as an inner diameter of the curved entrance geometry of the transition portion.

4. The steam turbine inlet assembly of claim 1, wherein an inner diameter of the annular ring and an inner diameter of the curved entrance geometry of the transition portion are aligned with one another.

5. The steam turbine inlet assembly of claim 1, wherein the polygonal exit geometry of the main body portion further comprises a rectangle.

6. The steam turbine inlet assembly of claim 1, wherein each of the transition portion and the main body portion further comprise rolled steel.

7. The steam turbine inlet assembly of claim 1, wherein the transition portion and the main body portion are welded together.

* * * * *